United States Patent [19]

Hope et al.

[11] 4,079,635

[45] Mar. 21, 1978

[54] WEB TRANSPORT SYSTEM USING STAGGERED ROLLERS

[76] Inventors: Henry F. Hope, 3912 Huntingdon Rd., Huntingdon Valley, Pa. 19006; Stephen F. Hope, 2548 Wyandotte Rd., Willow Grove, Pa. 19090

[21] Appl. No.: 737,199

[22] Filed: Oct. 29, 1976

Related U.S. Application Data

[63] Continuation-in-part of Ser. No. 555,961, Mar. 10, 1975, Pat. No. 3,989,176, which is a continuation-in-part of Ser. No. 457,829, Apr. 4, 1974, abandoned, and Ser. No. 513,244, Oct. 9, 1974, Pat. No. 3,952,610.

[51] Int. Cl.[2] ..... F16H 1/12; B41F 5/16; B41F 5/00

[52] U.S. Cl. ..... 74/421 R; 101/181; 101/216

[58] Field of Search ..... 74/421 R; 101/181, 216

[56] References Cited

U.S. PATENT DOCUMENTS

| | | | |
|---|---|---|---|
| 2,619,033 | 11/1952 | Lembo | 101/181 |
| 3,329,087 | 4/1967 | Sandor et al. | 101/181 |
| 3,416,444 | 12/1968 | Cahn | 101/181 |
| 3,841,216 | 10/1974 | Huffman | 101/181 |

*Primary Examiner*—Leonard H. Gerin
*Attorney, Agent, or Firm*—Weiser, Stapler & Spivak

[57] ABSTRACT

A transport roller rack highly efficient in use of power, especially suitable for photographic film developing machines. The rack combines transport rollers in staggered, non-nip forming configuration, with a power gear train having coaxial power tap-offs to clusters of roller driving gears.

Each cluster has its own cluster drive gear, which is coaxially rotated by a larger power gear.

Roller driving gears belonging to adjoining clusters also mesh with each other, thereby uniting these clusters into a continuous train of intermeshing roller driving gears.

Also, the method of transporting film by the use of this rack.

27 Claims, 9 Drawing Figures

WEB TRANSPORT SYSTEM USING STAGGERED ROLLERS

RELATED CASES

This application is a continuation-in-part of our copending U.S. patent application Ser. No. 555,961, filed Mar. 10, 1975, now U.S. Pat. No. 3,989,176 issued Nov. 2, 1976, which in turn is a continuation-in-part of our patent applications Ser. No. 457,829, filed Apr. 4, 1974, now abandoned, and Ser. No. 513,244, filed Oct. 9, 1974, now U.S. Pat. No. 3,952,610, issued Apr. 27, 1976.

In the foregoing, prior patent applications and now issued patent, there is taught a highly efficient, novel concept for powering racks containing long strings of transport rollers. In accordance with that concept, each roller is coaxially rotated by its own roller drive gear. Clusters of these roller drive gears are driven by respective cluster drive gears. The cluster drive gears, in turn, are coaxially rotated by power transmitting gears of larger pitch diameters.

The power transmitting gears drive each other, thereby providing the main flow of power to the rack. Each cluster drive gear taps off from this main flow of power the fraction needed to drive its own cluster of gears and their coaxially driven transport rollers.

The present application deals with additional embodiments of this novel concept, utilizing specific configurations of the transport rollers, and thereby demonstrates the broad scope of useful applicability of the concept.

BACKGROUND OF THE INVENTION

The present invention relates generally to a conveyor system for moving webs or sheets of material with maximum efficiency, with minimum power requirements and with minimal chatter, vibration and deflection. The system is especially suitable for photographic developing equipment.

Machines are known which utilize an extended transport roller system for carrying flexible workpieces, such as photographic films or papers. Typical of such machines are those used to develop photographic films. These utilize a series of treatment baths, through which films must pass in succession. Each bath takes place in a suitably shaped tank containing the treatment liquid. Within each tank, there is a rack of film transport rollers, so distributed within the tank that films are led down one side and back up the other side within the tank, being subjected to the treatment liquid for the duration of their passage through the tank. It is apparent that the larger the tank, the faster the films can be passed through the tank, while still maintaining the durations of treatment periods which are necessary for the various development processes to occur. The same is true for the drying stage, which customarily follows the last bath, and during which the films are subjected to air flow, rather than to a treatment liquid. It is conventional in such machines to have individual gears mounted at the ends of the rollers forming part of the racks. The driving force for each roller is provided through its individual gear.

In the type of transport roller racks here under consideration there is typically a string of many such roller-and-gear assemblies, all of which must be driven from a common power source located at one end of the string, usually near or above the top of the tank within which the respective rack is positioned.

Several techniques for accomplishing this have been utilized.

One technique has involved simply meshing together all the individual roller driving gears with one another, applying the common driving force for all of them to a gear close to the top of the tank, and letting the driving force propagate downwardly along the rack from one gear to another.

This technique has considerable appeal in various respects, and has in fact been widely employed in practice. It follows the accepted principle that a continuous train of gears is simplest to design, assemble and service. It is capable of utilizing mainly one size of gears, which lowers costs and simplifies maintenance. It is susceptible of using the smallest size of gears, which is consistent with the design principle that the smallest possible gears produce a lighter weight and smaller overall package, that the use of small diameter gears minimizes gear cost and results in an optimum gear quality, and that the smaller diameter gears have a lower pitchline velocity and will therefore wear less, last longer and be quieter in action and will give less of a thermal expansion problem.

On the other hand, machines using this technique, with their long series of driven rollers, are beset with the problem of the transmission of power to all these rollers through the corresponding long train of meshing power transmitting gears. For such gear trains, input torque required to overcome friction increases with each added meshing. The difference between the magnitudes of output and input power is attributable to losses due to gear teeth meshing and shaft bearing friction. Such conventional systems show a relatively rapid fall-off of efficiency with length. As shown by conventional systems in use, the number of rollers which can in practice be driven by such a system is severely limited. Also, the play between gear teeth is cumulative with the number of gear meshings, causing objectionable gear chatter, vibration and deflection, all of which increase as the distance from the input power drive increases.

In the case of photographic film processing machines, these defects are critical. They limit the depth of the film treatment tanks, and therefore also the speed with which film can be processed through the machines. Also, they are the cause of damage to the delicate photographic film, the film emulsion can become marked, and the film can show the effect of uneven transport through the system.

A major improvement over the technique described above is taught in the prior applications and issued patent referenced at the beginning of this application. In these prior cases, there is disclosed a system characterized by separation of those gears which transmit the main power along the roller rack from those gears which drive the individual rollers. Power supply, such as a motor, is provided to at least one of these power transmitting gears. The main driving power is transmitted through a plurality of power transmitting gears. From these power transmitting gears, there are tapped off fractions of this main driving power sufficient to drive clusters of gears which, in turn, drive fractions of the total number of transport rollers in the system. The drive from each power transmitting gear to the associated cluster of individual roller-driving gears takes place through a cluster drive gear, which is rotated at the same rate of rotation as the power transmitting gear. Preferably this is accomplished by having the cluster drive gear coaxially connected to the power gear.

Thus, the long train of gears driving the individual rollers in the rack is overbridged by a series of the large power transmitting gears, which are coaxially connected to the smaller cluster drive gears and which drive the long gear train through these cluster drive gears at relatively short intervals. Thus, the long gear train is broken down into a number of smaller clusters of efficiently driven gears, thereby overcoming the multiplying inefficiencies of long gear trains.

As is more fully explained in the above-mentioned prior patent applications and issued patent, the improved system taught therein makes it possible to drive much longer strings of rollers without requiring excessive input driving torque. The system therefore also makes it possible to use much larger tanks. This, in turn, makes possible much higher film processing speeds and output. At the same time, gear chatter and vibration are reduced throughout the system.

SUMMARY OF THE PRESENT INVENTION

In the present invention the rack has transport rollers positioned in a zig-zag or staggered pattern, without forming nips. Each roller has a coaxially mounted roller driving gear. These roller driving gears mesh with one another to form a pattern of meshing gears in the same zig-zag, staggered configuration as the rollers.

To this roller-and-gear construction, which is known in itself, power is applied through a gear system which embodies the same highly advantageous concept as is taught in the previously listed prior patent applications and issued patent.

This gear system includes a power gear train with coaxial cluster drive gear tap-offs to clusters of roller driving gears.

The power gear train consists of a series of power transmitting gears, which are positioned along the rack, and which drive one another.

The power transmitting gears, in turn, coaxially rotate cluster drive gears of smaller pitch diameter. Each cluster drive gear rotates through meshing a cluster of the individual roller driving gears.

In one embodiment of the present invention, the cluster drive gears are themselves mounted at the ends of transport rollers and thereby also serve as the roller driving gears for these particular rollers. In another embodiment, the cluster drive gears are not themselves mounted at the ends of rollers, but provide drive through meshing to the roller driving gears.

The diameter relationships between the power transmitting gears and the associated cluster drive gears are preferably similar to those taught in the prior patent applications and issued patent listed above. Typically, the power gear diameters are three to five times the diameters of the cluster drive gears which they coaxially rotate.

We have found that a rack constructed in accordance with the present invention can be driven with much less power than a rack which has the same number of staggered rollers, but in which the power is applied at one end of the train of staggered roller driving gears. This improvement takes place, despite the fact that the individual roller driving gears mesh with one another, not only within each cluster, but also between adjoining clusters.

Also in accordance with the present invention, the rack can be made with many more rollers, without prohibitively increasing the input driving power required for its operation.

In either case, gear chatter and vibration are reduced throughout the system. This, in turn, lessens the danger of damage to the film transported through the rack.

Accordingly, it is a principal object of the present invention to provide an improved transport roller rack of the type having staggered, meshing roller driving gears, and staggered rollers which do not form nips, and through which a web is transported in a sinuous path.

It is another object to provide such a rack in which the power input required is greatly reduced.

It is still another object to provide such a rack in which chatter and vibration are greatly reduced.

It is another object to provide such a rack whose length can be increased with only slight increase of the required driving power.

For further details, reference is made to the discussion which follows, in the light of the accompanying drawings, wherein:

BRIEF DESCRIPTION OF DRAWINGS

The same reference numerals are used in the different figures to designate corresponding elements.

DETAILED DESCRIPTION

Referring to FIGS. 1–4, these all show different views of the same transport roller rack 1, adapted to be inserted, for example, in a treatment tank (not shown) of a photographic film developing machine, and to convey pieces of film through that tank.

Figure 3:
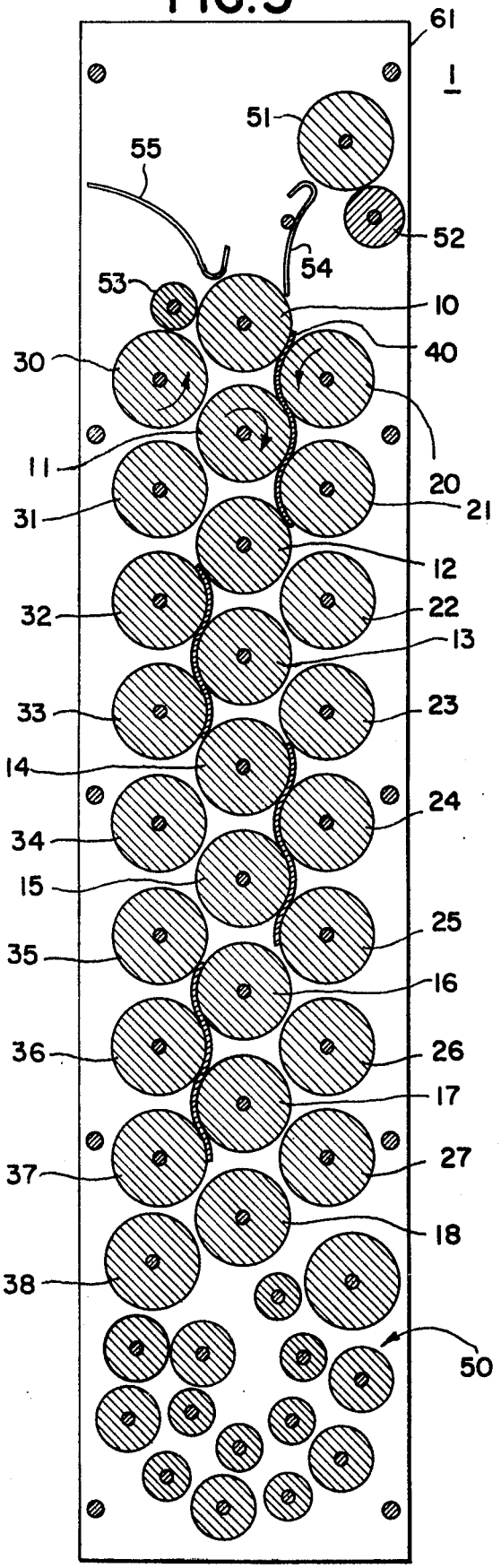
FIG. 3 is a side elevation of the rack of FIG. 1, viewed from the same side as in FIG. 1, but with gears and frame removed to expose the rollers within the frame.

As is particularly apparent from FIG. 3, this rack includes three sets of rollers arranged in parallel, vertical rows. The middle set consists of nine rollers numbered 10 through 18 (from top to bottom). The right outer set consists of eight rollers numbered 20 through 27. The left outer set consists of nine rollers 30 through 38.

The rollers in the outer rows are staggered with respect to the rollers forming the middle row. The relative positioning of these rollers, both horizontally and vertically, is such that pieces of material 40 (e.g., photographic films) introduced between adjacent rows will follow a sinusoidal path, as shown in FIG. 3.

At the bottom of these three rows of staggered rollers, there is a group of turn-about rollers collectively designated by numeral 50, which serve to reverse the direction of the films 40 from downward to upward, as they are transported through the roller rack.

At the top of the sets of staggered rollers 10–38, there are three additional rollers 51–53. Of these, roller 51 forms with roller 52 a nip which serves as the lead-in for films 40 to be introduced into rack 1. A curved guide plate 54 is positioned to cooperate with the rollers and guide such films emerging from the nip of rollers 51, 52 into the space between staggered rollers 10, 20. Roller 53 forms a nip with roller 10 and serves to propel films 40 emerging from being transported through rack 1 out of the rack, with further guidance being imparted by curved guide plate 55.

Figure 1:
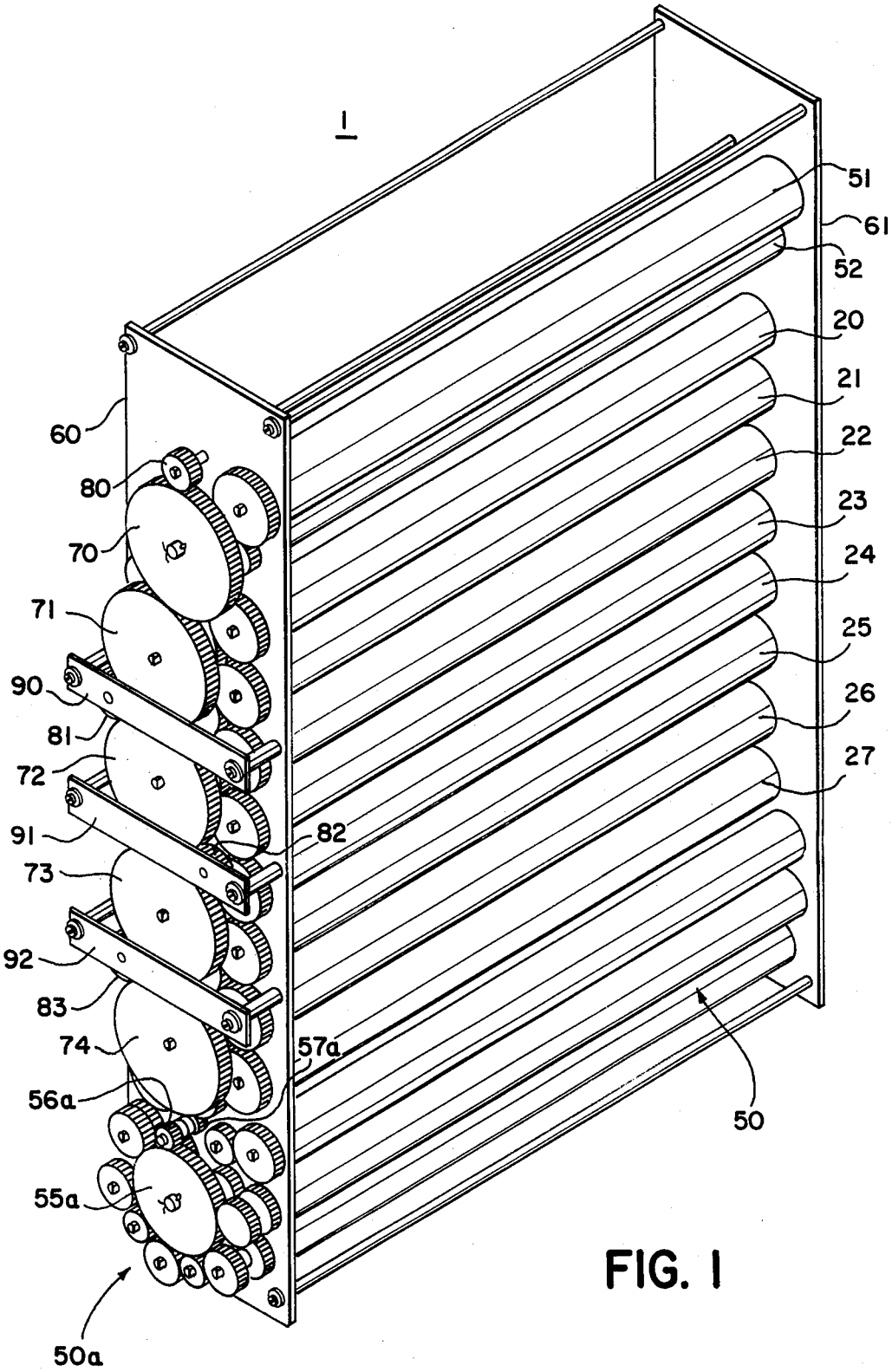
FIG. 1 is an overall perspective view of a transport roller rack embodying the present invention.
Figure 2:
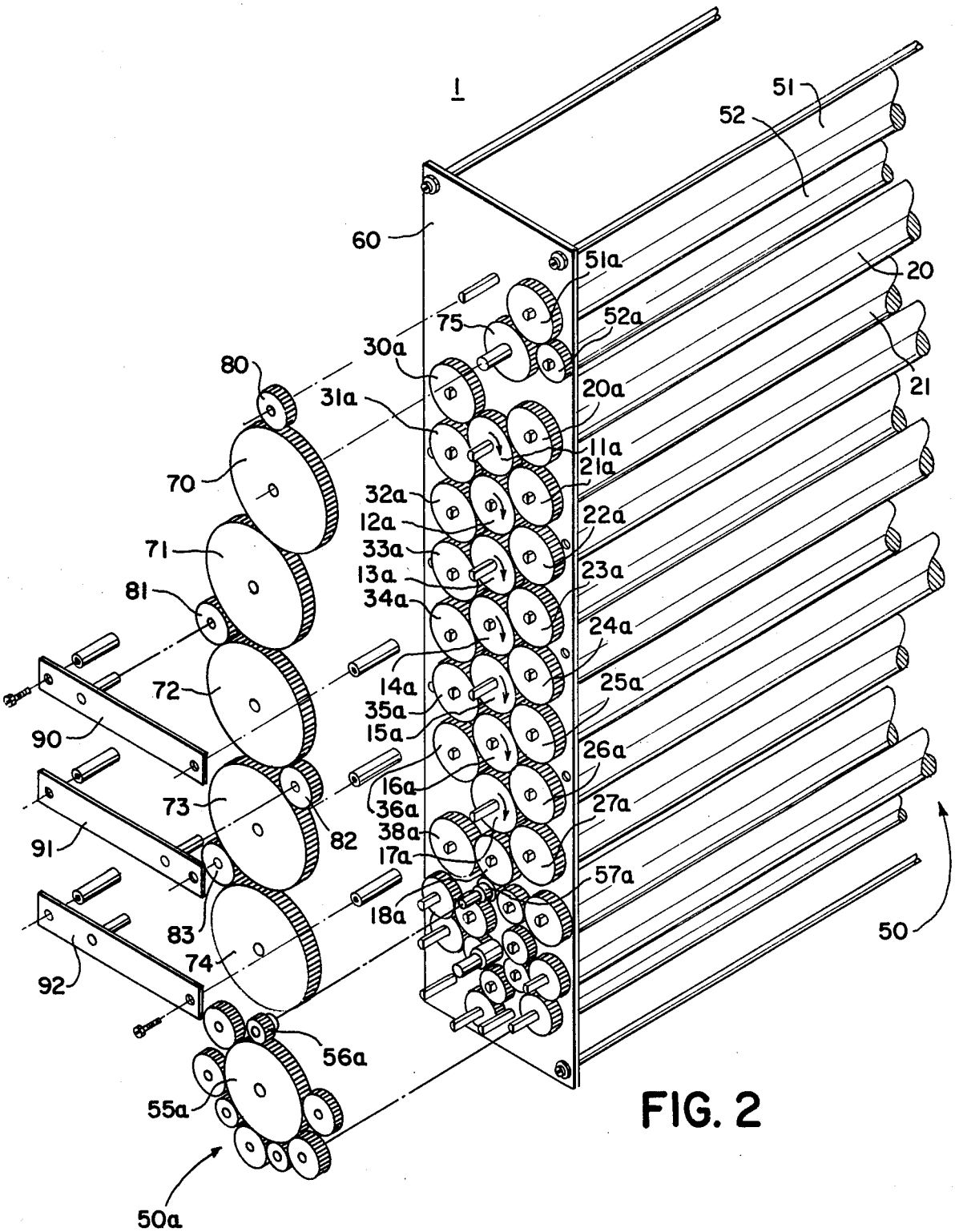
FIG. 2 shows a portion of the same rack as FIG. 1, with one layer of gears separated to show the underlying gear configuration.
Figure 4:
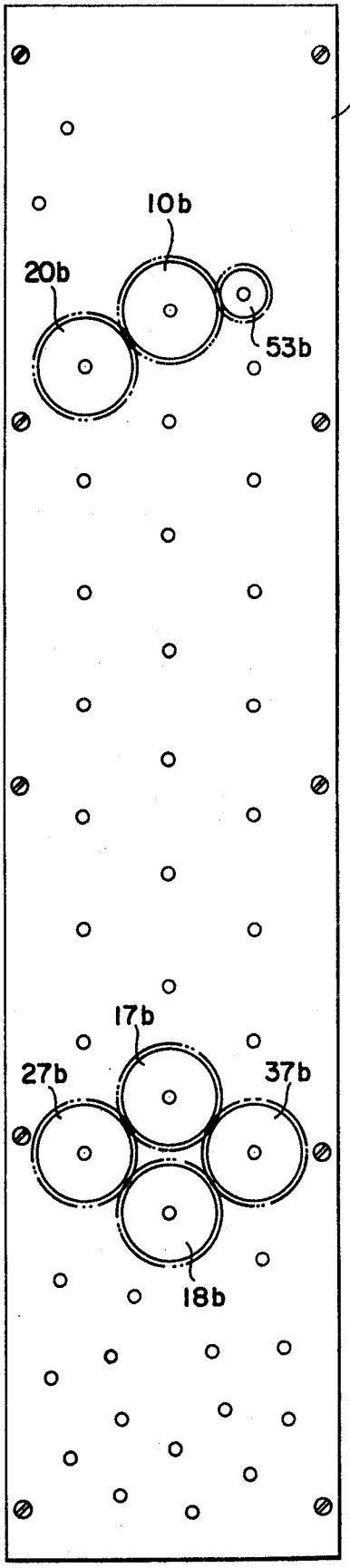
FIG. 4 is a side elevation of the rack of FIG. 1 viewed from the side opposite to that of FIG. 1.

The rollers are all held in horizontal positions between frame members 60, 61 (see also FIG. 1), and are mounted on shafts journaled for rotation within these frame members. All the rollers shown in FIG. 3 are driven by gears, which are shown in FIGS. 1, 2 and 4. In FIG. 2, particularly, there is shown a set of gears 11*a* through 18*a*, respectively attached to the ends of the same shafts on which are mounted rollers 11 through 18 (FIG. 3). There is also a set of gears 20*a* through 27*a* attached to the corresponding rollers 20 through 27, a set of gears 30*a* through 36*a* and 38*a* attached to corresponding rollers 30 through 36 and 38, and a set of gears 50*a* (FIG. 1) attached to corresponding ones of the set of turn-about rollers 50 (FIG. 3).

All of the gears mentioned heretofore are attached to the respective rollers of the ends nearest the viewer in the perspective views of FIGS. 1 and 2, and on the outside of frame member 60.

Rollers 10 and 37, it will be noted, do not have gears at these ends. Rather they have gears 10*b* and 37*b* attached to the opposite ends of these respective rollers, as seen in FIG. 4, on the outside of frame member 61.

Moreover, rollers 17, 18, 20, 27 and 53 also have gears at these opposite ends, outside of frame member 61, such gears being designated 17*b*, 18*b*, 20*b*, 27*b* and 53*b* in FIG. 4. These five rollers then have gears at both ends.

The staggered rollers in the three vertical rows are so dimensioned that they do not touch, i.e., so that they do not form nips for the engagement of the films 40 to be transported by them. On the other hand, the gears attached to these rollers which are designated by the suffix "*a*" are so dimensioned that they do mesh along diagonal lines, but not vertically. In other words, each gear 11*a* through 18*a* meshes with diagonally adjacent gears having reference numbers with the suffix "*a*" in the 20's and 30's, but not with its vertically adjacent gear or gears having reference numbers in the 10's.

Likewise, the gears 10*b*, 17*b* and 18*b* on the opposite ends of the rollers mesh diagonally with "*b*" suffix gears, but not with one another.

Thus, the gears at the ends of the sets of staggered rollers likewise form sets of staggered gears. As a result, these gears will all rotate in unison and so will the rollers to which they are attached. More particularly, if the middle gears (e.g., 11*a*, etc.) rotate in a clockwise direction, as indicated by arrows drawn on these gears in FIG. 2, then the outer gears 20*a*, etc. and 30*a*, etc. will rotate counterclockwise. The corresponding rotational movements will prevail for the rollers to which these gears are attached (FIG. 3).

It will be apparent from FIG. 3 that the effect of this is to impart a downward movement to films 40 introduced at the top between rollers 10 and 20, and a subsequent upward movement between rollers 10 and 30. The transition between downward and upward movements is accomplished by the set of turn-about rollers 50, which are disposed in two generally semicircular rows.

The outer row of rollers in set 50 is rotated counterclockwise and the inner clockwise, to continue the movements imparted by sets of staggered roller 10 through 38.

We now come to a key difference between the present invention and the prior art. In prior art arrangements using sets of staggered rollers driven by sets of meshing, staggered gears, the driving force for the entire rack was customarily applied at one point, usually the top of the rack. For example, a motor-driven pinion might have been positioned to mesh with the top-most staggered gear of the rack, and the driving force so imparted would then have been transmitted and distributed to the other gears in the rack through the many meshes between adjacent gears in the staggered rows, plus those used for turn-about purposes.

In a rack such as shown in the drawings of the application, this would have meant that the driving force applied, for example, to gear 20*a* (FIG. 2) would have had to be transmitted to gear 11*a*, then to gear 21*a*, then to gear 12*a*, and so forth in a zig-zag path through 15 meshes in order to reach gear 18*a* driving a roller (roller 18 in FIG. 3) which is only 8 rollers below the top-most roller in the middle set of rollers 10–18 (FIG. 3). This led to a very inefficient transmission of the driving forces throughout the rack and, in turn, severely restricted the size of the rack which could be constructed as a practical matter in the prior art. Moreover, there was severe chatter in the operation of the rack. This caused wear and tear on the gears, bearings and other delicate parts and —even worse— streaking, scratching and smearing of the emulsions on the photographic films being transported through the rack.

In accordance with the present invention, all of these debilitating problems are overcome at one stroke by utilizing an additional set of gears, not in mesh with any of the gears of rack 1 heretofore discussed.

In the embodiment of FIGS. 1–4, this additional set of gears is visible in FIGS. 1 and 2. It consists of the five large-diameter gears 70–74, and the four small gears 80–83 associated with these large gears.

It will be seen that gears 71–74 are coaxially mounted with gears 11*a*, 13*a*, 15*a* and 17*a*, respectively, in the middle row of the staggered gear sets at the ends of the corresponding staggered rollers. Gear 70 is coaxial with a gear 75 which is not attached to any roller, but which meshes with gear 51*a* mounted at the end of roller 51 and in turn meshes with gear 52*a* at the end of roller 52.

Gears 80–83 are also not attached to rollers, but only to rack frame 60, and to brackets 90–92, respectively.

Driving power for the entire rack 1 is applied at the top of the rack through gear 80, e.g. from a motor through a suitable drive pinion (not shown).

This driving power then flows down through gears 70–74, which will be referred to hereafter as the power transmitting gears, or power gears, for short. As will be seen, the small gears 80–83 serve to reverse direction from one power gear with which any of them meshes to the next such power gear so that the four power gears 71–74 rotate in the same direction.

Through the coaxial connection between each power gear 70–74 and the corresponding smaller gear 75, 11*a*, etc. which it respectively rotates, there is tapped off a portion of the power flowing down the series of power gears and applied to the remaining gears of the rack 1 and through them to the rollers. These coaxially connected smaller gears will be referred to hereafter as the cluster drive gears. In this embodiment, it will be noted that these cluster drive gears combine two functions. One function of each cluster drive gear is to directly drive the transport roller at the end of whose shaft it is mounted. The other function is to transmit, through meshing, driving power to other gears driving nearby rollers. A group of such roller driving gears in the vicinity of any given cluster drive gear and directly or indirectly meshing with same, is referred to as a cluster.

This system of power gears, with partial power tap-offs through the respective cluster drive gears to clusters of adjoining gears which also actually drive rollers, results in a remarkable increase in efficiency of operation of the entire rack 1. The larger power gears overbridge the long train of smaller gears that drive the rollers themselves and break that long train of gears down into efficiently driven smaller clusters. This efficiency increase is so pronounced that much larger racks (with much longer strings of rollers) become practical. Not only can such larger racks be driven without resorting to impractical motor sizes, but chatter and vibration are also startlingly reduced, and with them the wear and tear on the rack itself and the danger of damage to the films.

In the present invention, some of the clusters of roller drive gears mesh with each other, and through them so do their respective cluster drive gears. For example, cluster drive gear 15*a* (which is rotated coaxially by power gear 72) is in meshing engagement (through roller drive gears 24*a*, 23*a*, 34*a*, 33*a* and 14*a*) with cluster drive gear 13*a* (coaxially rotated by power gear 71). Cluster drive gear 15*a* is also in meshing engagement (through roller drive gears 25*a*, 26*a*, 35*a*, 36*a* and 16*a*) with cluster drive gear 17*a*. It is remarkable that, even in the presence of this complete intermeshing between the several cluster drive gears coaxially rotated by the several power gears, there is nevertheless achieved the increase in efficiency and reduction in chatter and vibration which in fact takes place.

It should be noted that gear 55*a* forming part of turn-about gear set 50*a*, although larger than other gears in set 50*a*, is not a power gear in the same sense as power gears 70–74. Gear 55*a* does not coaxially rotate any other gear, and therefore does not serve as a power tap-off point in the same sense as the power gears 70–74. Rather gear 55*a*, itself, is mesh-driven by pinion 56*a* which is in turn coaxially rotated by pinion 57*a*, which is in turn mesh-driven by gear 18*a*. Gear 55*a* defines by its periphery the positions occupied by the outer series of turn-about rollers forming part of set 50 and their respective driving gears. The inner series of turn-about rollers forming part of set 50 are driven in turn by gears which mesh with gears coaxially driven by those meshing with the periphery of gear 55*a*. The reason for this two-tier construction of the gears in set 50*a* is that it permits these gears to be driven by the comparatively large gear 55*a*, whose slow rotational speed is well suited to deliver the driving power smoothly to the many other gears in the set.

Figure 6:
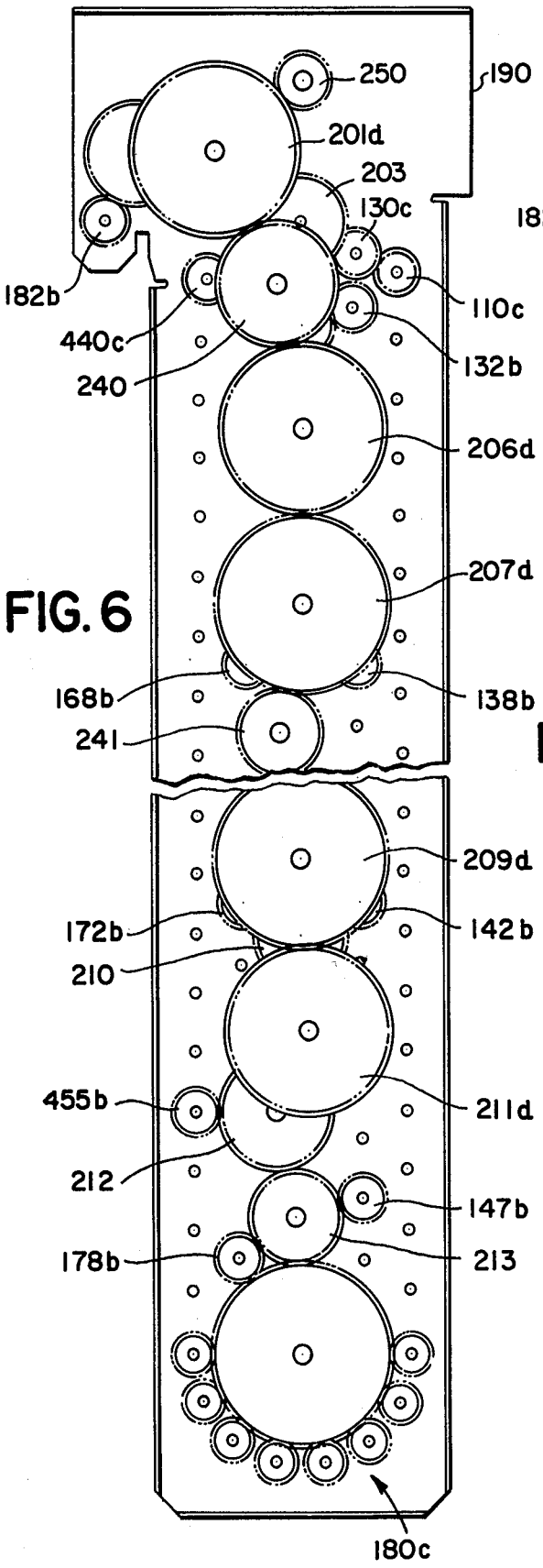
FIG. 6 is a side elevation of the rack of FIG. 5, viewed from the same side as in FIG. 5.
Figure 7:
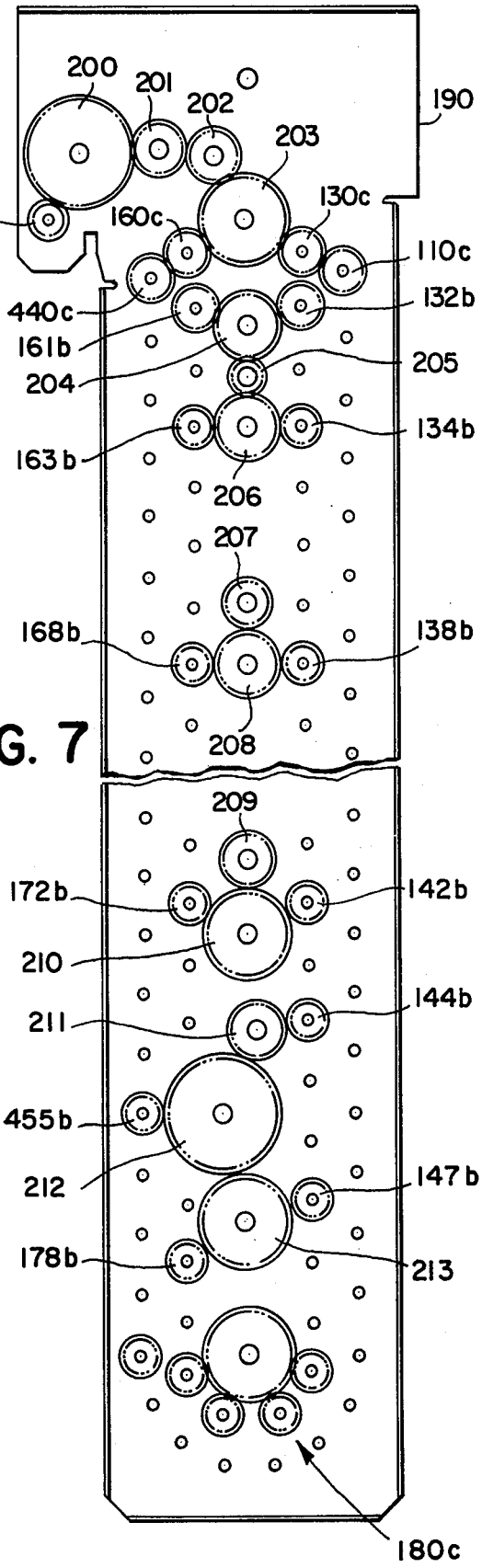
FIG. 7 is the same side elevation as FIG. 6, except that the same layer of gears has been removed as was shown separated in FIG. 5.
Figure 8:
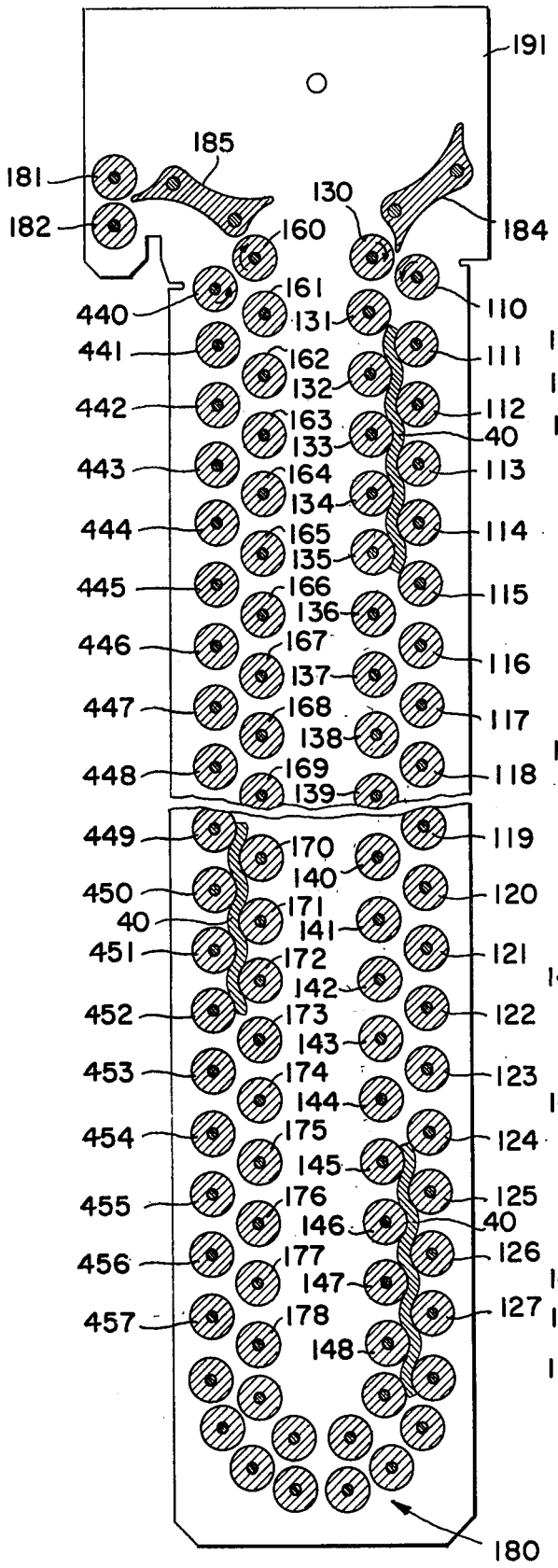
FIG. 8 is the same side elevation as FIG. 6, but with all the gears on the viewing side removed, and with the near frame member also removed to expose the rollers within the frame.

Turning now to the second embodiment of the invention, different views of which are illustrated in FIGS. 5 through 9 of the drawings, this consists of a transport roller rack 101 in which, as is particularly apparent from FIG. 8, there are two pairs of sets of staggered rollers. One pair is constituted of a vertical row of 18 rollers 110 through 127 and a parallel, but staggered row of 19 rollers 130 through 148. The other pair is likewise constituted of a vertical row of 18 rollers 440 through 457 and parallel, but staggered row of 19 rollers 160 through 178. At the bottom of the rack 101, there is a set of turn-about rollers 180 in two parallel, roughly semicircular rows.

There are also two rollers 181, 182 positioned at the top of the rack 101, defining a nip between them.

By means which are described in more detail below, all these rollers are rotated in unison.

The rollers 130–148 and 160–178 all rotate in the same direction, e.g., clockwise as indicated by the arrows in the two rollers 130 and 160. The continuation of these roller rows in the turn-about roller set 180 also rotate in the clockwise direction, and so does roller 181. The remaining rollers all rotate in the opposite direction, namely counterclockwise as indicated by the arrows in rollers 110 and 440.

As a result, films 40 introduced from above and from the right between rollers 110, 130 will be transported downwardly between the pair of rows of staggered rollers of which these are members, then around the turn-about roller set 180, and back up between the pair of staggered roller rows of which rollers 440 and 160 form part.

Guide 184 is positioned to define a path for these films as they are introduced between rollers 110, 130. Guide 185 is positioned to define a path for the films as they emerge from between rollers 440, 160. Guide 185 deflects these emerging films into the nip between rollers 181, 182, by means of which they are delivered from the rack 101.

The rollers of FIG. 8 are horizontally supported between rack frame members 190, 191 (See FIG. 5), in which they are journaled for rotation. Guides 184 and 185 are also mounted between these frame members 190, 191.

Figure 9:
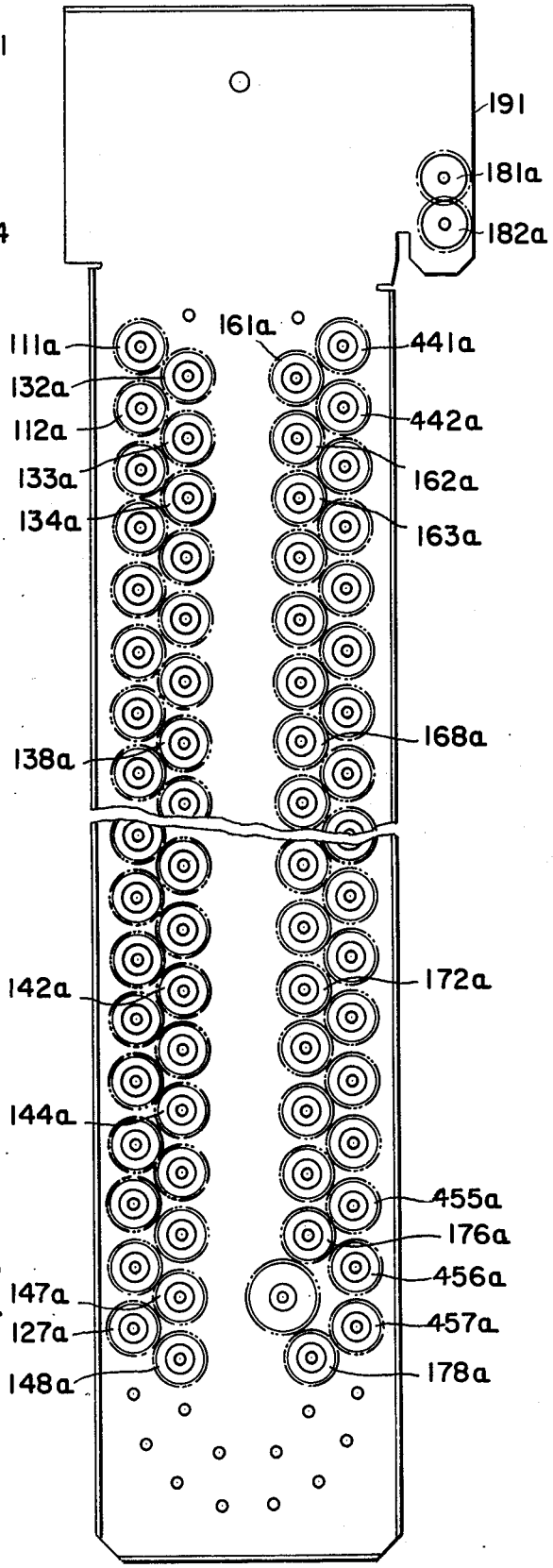
FIG. 9 is a side elevation of the rack of FIG. 5 viewed from the side opposite to that of FIG. 5.

Each of the rollers illustrated in FIG. 8 is driven by a gear with which that roller is coaxially mounted on a common shaft. FIG. 9 shows a set of these gears mounted respectively at the ends of rollers forming part of the pairs of sets of staggered rollers illustrated in FIG. 8. In FIG. 8, the gear at the end of any given roller has been designated by the same reference numeral as that roller, but with the suffix "*a*" added. Thus, gear 111*a* in FIG. 9 is at the end of roller 111 in FIG. 8, gear 112*a* is at the end of roller 112, and so forth. It will be understood that the gears shown in FIG. 9 are positioned on the opposite side of frame member 191 from the rollers of FIG. 8. Therefore, the pattern of gears shown in FIG. 9 forms a mirror image of the pattern of corresponding rollers in FIG. 8.

Some of the rollers shown in FIG. 8 have gears not only at the ends nearest frame member 191, as shown in FIG. 9, but also at the ends nearest frame member 190. These gears nearest frame member 190 are shown most clearly in FIG. 7, where they are designated by the same reference numerals as the respective rollers, followed by the suffix "*b*". Thus, FIG. 7 shows a gear 132*b* at the end of roller 132 nearest frame member 190. This roller 132 also has a gear 132*a* at the end of this roller nearest frame member 191.

Other rollers shown in FIG. 8 have gears only at their ends nearest frame member 190. These gears are designated by the same reference numerals as their respective rollers, but with the suffix "*c*". Thus, roller 110 (FIG. 8), for example, has a gear 110*c* (FIG. 7) attached to its end nearest frame member 190, roller 130 has such a gear 130*c*, and so forth for other rollers in the rack 101.

Also part of the rack 101 there is a number of gears which are not attached to the ends of any rollers, but rather are attached by their respective shafts to frame member 190 and are in mesh, directly or through intervening gears, with certain ones of the gears mounted at the ends of rollers. These gears are designated by reference numerals 200 through 213, and are particularly clearly visible in FIGS. 5 and 7.

Figure 5:
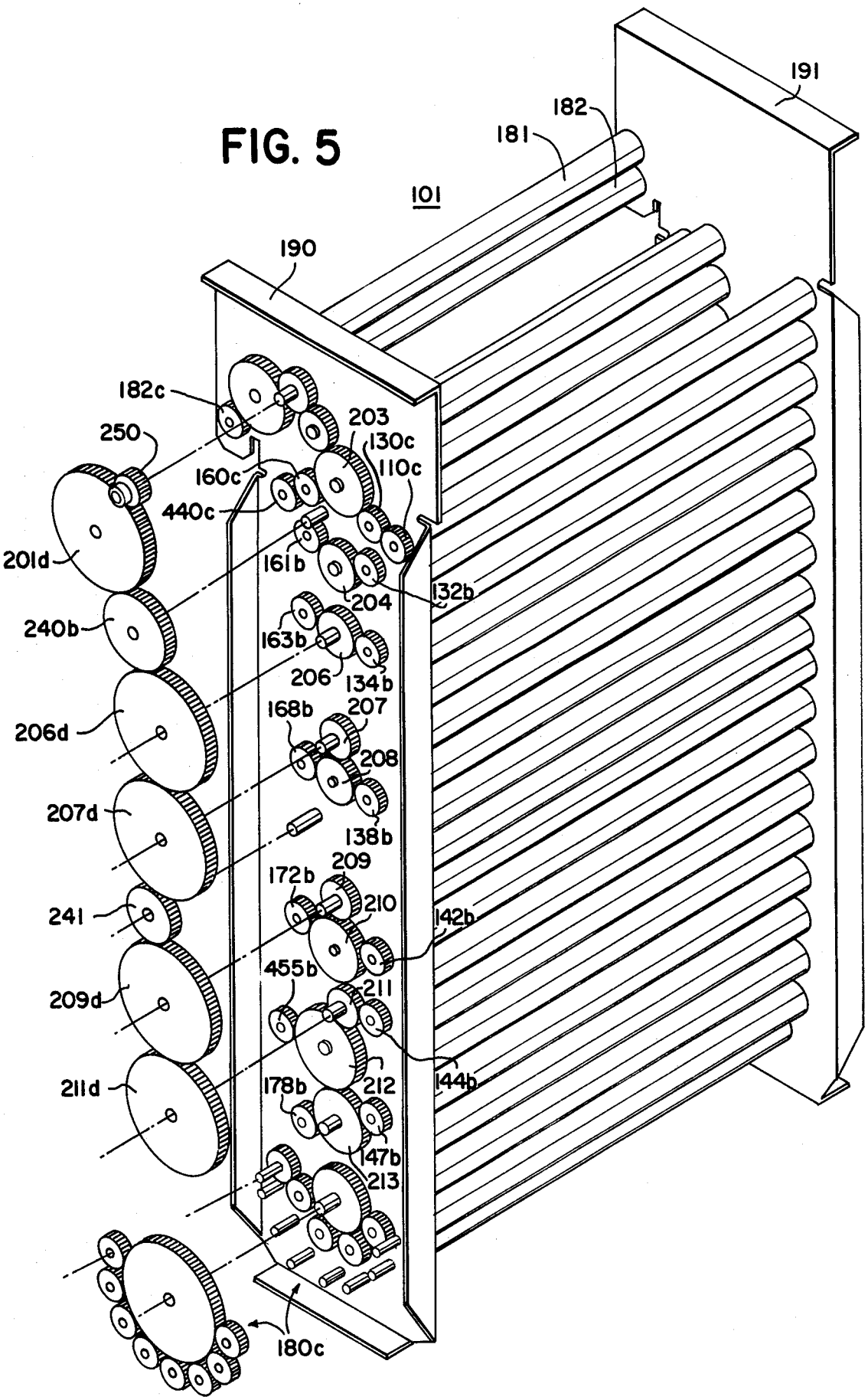
FIG. 5 is an overall perspective view of another transport roller rack embodying the invention, with one layer of gears separated from the others to reveal more clearly the underlying gear configuration.

Mounted for coaxial rotations of some of these gears 200 through 213 is a set of larger gears, respectively bearing the same reference numerals as their coaxially rotated gears, but with the suffix "*d*". These are shown in FIGS. 5 and 6. There are five such larger gears 201*d*, 206*d*, 207*d*, 209*d* and 211*d*.

For reasons which will become apparent, these five larger gears will be referred to as the power gears of this embodiment, and the smaller gears which they coaxially rotate will be referred to as the cluster drive gears.

Between power gears 201*d* and 206*d* there is a reversing gear 240 and between power gears 207*d* and 209*d* there is another reversing gear 241 (See FIGS. 5 and 6). These reversing gears are also not attached to any rollers, but have shafts which terminate at frame member 190 of rack 101.

Finally, a pinion 250 meshes with power gear 201*d*. This pinion may be rotated by a suitable power source, e.g., a motor (not shown). Rotation of pinion 250 in turn sets into motion the power gears 201*d*–211*d*.

Their rotation is transferred to the cluster drive gears 201–211 which they coaxially rotate, and from there, the rotation is further distributed throughout the rack partly via the gears which mesh with cluster drive gears 201–211, and partly through the rollers which rotate the gears with suffixes "*a*" on the far side of the rack 101 from that at which the power gears are positioned.

Unlike in the embodiment of FIGS. 1–4, in the embodiment which is presently under discussion, namely that of FIGS. 5–8, none of the staggered, meshing gears which are mounted at the ends of staggered rollers are themselves, coaxially rotated by power gears. Rather, the rotation of the staggered, roller-mounted gears takes place through the cluster drive gears 201, 206, 207, 209 and 211 which are coaxially rotated by respective power gears.

However, the same advantage accrues in the present embodiment as in that of FIGS. 1–4. That is, the driving power for the entire rack 101, which is applied at the top of the rack through pinion 250, flows down through power gears 201*d*–211*d*. Through the coaxial connection between end power gear 201*d*–211*d*, and the corresponding coaxially rotated cluster drive gears 201–211, there is tapped off a portion of the power flowing down the series of power gears. These tapped-off portions of the power are applied to the remaining clusters of gears in rack 101 and through them to the rollers.

Again, there is obtained a remarkable increase in efficiency, and decrease in unwanted side-effects such as chatter and vibration, despite the fact that different clusters of the gears which actually drive the rollers themselves intermesh with one another.

It will be understood that the specific pitch diameters of the various gears utilized in either of the embodiments described above will be selected to achieve the desired surface speeds for all the rollers in the racks. These rollers should all rotate to produce uniform surface speeds for films transported through the rack.

Preferably, the pitch diameters of the power gears in each embodiment are chosen to be as large as practical, bearing in mind the space available within the confines of the rack and their side frame members. The pitch diameter of any one power gear relative to the cluster drive gear which it coaxially rotates is preferably of the order of at least three-to-one, and need not be an integral multiple.

It will also be seen that, in both of these embodiments, there are no shafts extending across the width of the rack, i.e., between frame members 60, 61 or 190, 191, other than those on which rollers are mounted. This minimizes the number of bearings which have to be provided in the racks.

The use of staggered rollers is advantageous in that the absence of nips reduces the manufacturing tolerances which are otherwise applicable to nip-forming rollers.

It will be understood that various modifications may be made, without departing from the inventive scope. For example, if the frame members 190, 191 in the embodiment of FIGS. 5–9 were wide enough then it would be possible to reposition all of the gears which are now adjacent frame member 191 (these are the gears with suffix "*a*" designations in FIG. 9), so as to be instead adjacent frame member 190. This would result in the elimination of some duplication of gears. Specifically, if all those gears designated with suffix "*a*" were repositioned to be adjacent frame member 190 (FIGS. 5 and 7) those gears designated with suffix "*b*" could be omitted. Of course, the geometry of the other gears adjacent frame member 190 would have to be appropriately modified to allow for the presence of the gears repositioned from the other side of rack 101.

It will also be understood that not all the rollers used in any given rack which is driven in accordance with the present invention need to be in staggered configuration. The rack can also include segments in which the rollers are positioned to form nip-defining pairs, and still be driven by the same system of large power gears and smaller cluster drive gears which is described above.

It will be seen that, throughout, the present patent application deals with embodiments of a novel and highly advantageous concept taught in the above-identified prior patent applications and patent. That concept involves in every instance, supplying the main flow of power to a long string of transport rollers through a small number of large power gears positioned along the roller string. Portions of this main power are tapped off for application to the rollers themselves by cluster drive gears of smaller pitch diameter, coaxially rotated by different ones of the power gears.

We claim:

1. The method of efficiently powering a transport roller rack which is capable of carrying a web, such as photographic film, along a sinuous path provided by transport rollers which are positioned in a staggered pattern without forming nips, the method comprising:

applying power to a train of power gears driving each other, causing the power gears to rotate, tapping-off power coaxially from the power gears and transferring it to and driving cluster drive gears having smaller diameter than the associated power gears, transmitting the tapped-off power from the cluster drive gears to clusters of gears, which gears rotate the staggered rollers, and thus transporting the web along the sinuous path provided by the staggered rollers in the rack.

2. The method of claim 1 wherein a cluster drive gear is directly rotating a roller.

3. The method of claim 1 wherein a cluster drive gear is driving a cluster gear, which cluster gear is directly rotating a roller.

4. The method of claim 1 wherein gears in adjoining clusters are meshing with each other.

5. A transport roller rack for transporting webs, such as photographic film, comprising:

a series of transport rollers positioned in a staggered pattern without forming nips to transport the films through the rack along a sinuous path;

in combination with and rotated by a gear system which includes a plurality of power transmitting gears driving each other, a plurality of cluster drive gears coaxially rotated by the power transmitting gears, each cluster drive gear having a pitch diameter smaller than the associated power transmitting gear, and a plurality of clusters of gears for coaxially rotating the transport rollers, each cluster of gears being driven by a cluster drive gear.

6. The rack of claim 5 wherein the cluster drive gears drive, through meshing, gears which coaxially rotate transport rollers.

7. The rack of claim 5 wherein the cluster drive gears coaxially rotate transport rollers.

8. The rack of claim 7 wherein the staggered rollers are lined up in three generally parallel rows, and the cluster drive gears coaxially rotate rollers in the middle row of the three parallel rows.

9. The rack of claim 8 wherein the cluster drive gears coaxially rotate non-consecutive rollers in the middle row.

10. The rack of claim 7 wherein each cluster drive gear also drives, through meshing, at least one other gear which coaxially rotates a transport roller.

11. The rack of claim 5 wherein the cluster drive gears do not coaxially rotate transport rollers.

12. The rack of claim 11 wherein the staggered rollers are lined up in two pairs of generally parallel rows, one pair for transporting the films in one direction and the other pair for transporting the films in the opposite direction, and each cluster drive gear drives at least one gear which coaxially rotates a roller in one pair of rows and one gear which coaxially rotates a roller in the other pair of rows.

13. The rack of claim 11 wherein the gears which coaxially rotate rollers are mounted at the ends of the rollers opposite the ends which are nearest to the cluster drive gears.

14. The rack of claim 13 wherein the power gears are nearest the same ends of the rollers as the cluster drive gears.

15. A transport roller rack for transporting webs, such as photographic films, comprising:

a series of transport rollers positioned in a staggered pattern without forming nips to transport the films through the rack along a sinuous path;

in combination with and rotated by a gear system which includes a plurality of clusters of gears for coaxially rotating the transport rollers, a plurality of cluster drive gears for rotating the clusters of gears, and a plurality of power transmitting gears driving each other for coaxially rotating the cluster drive gears, each power transmitting gear having a pitch diameter greater than the associated cluster drive gear.

16. A transport roller rack for transporting a web, comprising:

a string of transport rollers positioned in a staggered pattern without forming nips to transport the web through the rack;

a plurality of power transmitting gears driving each other;

a plurality of cluster drive gears coaxial with and rotated by the power transmitting gears, a plurality of cluster drive gears having a pitch diameter smaller than the corresponding associated power transmitting gear and providing power tap-off from its corresponding power gear; and a plurality of clusters of gears for coaxially rotating the transport rollers, each cluster of gears being driven by a cluster drive gear.

17. The transport roller rack of claim 16, wherein there are two pairs of sets of staggered transport rollers.

18. The transport roller rack of claim 17, which comprises a set of turn-about rollers.

19. The transport roller rack of claim 16, wherein the staggered rollers are positioned in a set of three rows, one row of which is positioned intermediate the two other rows.

20. The transport roller rack of claim 19, which comprises a set of turn-about rollers.

21. The method of efficiently powering a transport roller rack which is capable of carrying a web of emulsion bearing photographic material, such as photographic film, along a sinuous path provided by transport rollers which are positioned in a staggered pattern without forming nips, the method comprising:

simultaneously driving a plurality of power gears to cause said power gears to rotate, tapping-off power coaxially from the power gears and transferring it to and driving cluster gears having smaller diameter than the associated power gears, transmitting the tapped-off power from the cluster drive gears to clusters of gears, which gears rotate the staggered rollers, and thus transporting the web along the sinuous path provided by the staggered rollers in the rack.

22. The method of claim 21 including directly rotating a roller with a cluster drive gear.

23. The method of claim 21 including driving a cluster gear with a cluster drive gear and directly rotating a roller with the driven cluster gear.

24. A transport roller rack especially for rollers in a staggered arrangement for transporting webs of emulsion bearing photographic material, such as photographic film, comprising:

a series of transport rollers positioned in a staggered pattern without forming nips to transport the films through the rack along a sinuous path;

in combination with and rotated by a gear system which includes a plurality of simultaneously driven power transmitting gears, a plurality of cluster drive gears coaxially rotated by the power transmitting gears, each cluster drive gear having a pitch diameter smaller than the associated power transmitting gear, and a plurality of clusters of gears for coaxially rotating the transport rollers, each cluster of gears being driven by a cluster drive gear.

25. The rack of claim 24 wherein the cluster drive gears drive, through meshing, gears which coaxially rotate transport rollers.

26. The rack of claim 24 wherein the cluster drive gears coaxially rotate transport rollers.

27. A transport roller rack especially for rollers arranged in a staggered arrangement for transporting webs of emulsion bearing photographic material, such as photographic films, comprising:

a series of transport rollers positioned in a staggered pattern without forming nips to transport the films through the rack along a sinuous path;

in combination with and rotated by a gear system which includes a plurality of clusters of gears for coaxially rotating the transport rollers, a plurality of cluster drive gears for rotating the clusters of gears, and a plurality of simultaneously driven power transmitting gears for coaxially rotating the cluster drive gears, each power transmitting gear having a pitch diameter greater than the associated cluster drive gear.

* * * * *